United States Patent [19]

Hoskinson

[11] 4,342,269

[45] Aug. 3, 1982

[54] MATERIAL TREATING APPARATUS UTILIZING AN AUGER HAVING AN INTERNAL AIR SUPPLY AND HEAT TRANSFER SYSTEM

[76] Inventor: Gordon H. Hoskinson, 186 Mayfair Rd., Floral Park, N.Y. 11001

[21] Appl. No.: 207,666

[22] Filed: Nov. 17, 1980

[51] Int. Cl.[3] ..... F23G 3/00

[52] U.S. Cl. ..... 110/257; 110/253; 198/657; 414/197

[58] Field of Search ..... 110/255, 257, 327, 346, 110/110, 267; 414/197; 198/167, DIG. 952

[56] References Cited

U.S. PATENT DOCUMENTS

| | | | |
|---|---|---|---|
| 3,942,455 | 3/1976 | Wallis | 110/8 |
| 4,009,667 | 3/1977 | Tyer et al. | 110/255 X |
| 4,231,304 | 11/1980 | Hoskinson | 110/157 |

*Primary Examiner*—Edward G. Favors
*Attorney, Agent, or Firm*—Andrus, Sceales, Starke & Sawall

[57] ABSTRACT

A material treating apparatus, such as an incinerator, incorporating an auger having an internal air supply system and an internal heat transfer mechanism. The incinerator includes a cylindrical combustion chamber containing a rotatable auger, and waste material is fed to one end of the combustion chamber and is conveyed through the chamber by the auger, while ash and non-combustible residue are discharged from the opposite end of the chamber. The auger is composed of a tubular shaft which carries a hollow spiral flight. Air is introduced into the downstream end of the shaft and flows through the hollow flight and is discharged through outlet ports in the periphery of the flight into the combustion chamber. To cool the auger, water flows within internal passages in the hollow flight. The flight is formed with a forward wall facing downstream and a rear wall which is spaced from the forward wall to define a central air passage. Both the forward and rear walls are composed of generally parallel wall panels which define a plurality of radially spaced water passages which extend the length of the flight. Ports interconnect the water passages and are arranged so that the greatest volume of water flows in the outermost passage.

13 Claims, 9 Drawing Figures

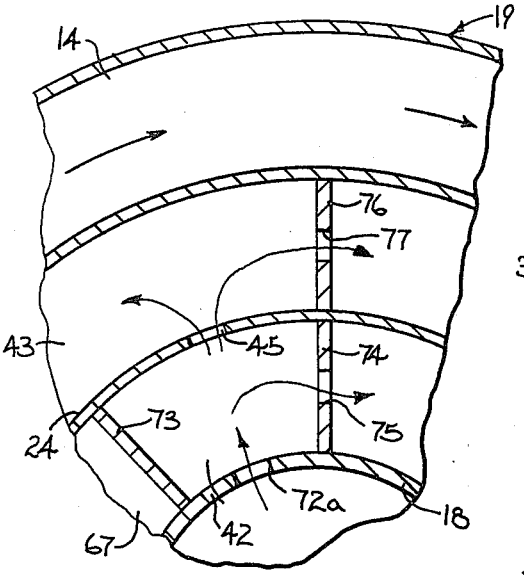
FIG.5
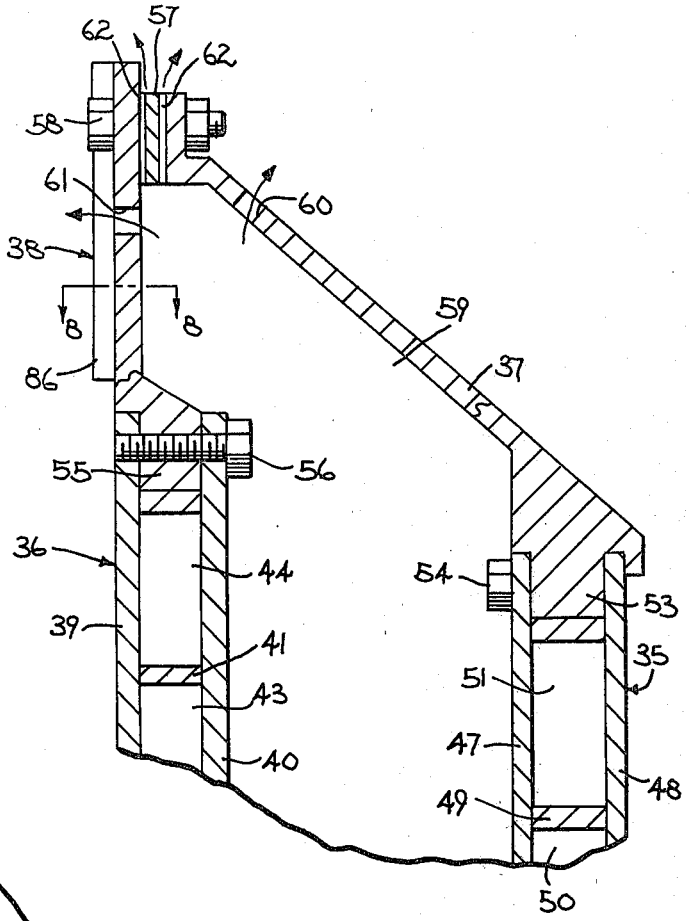
FIG.6
FIG.7
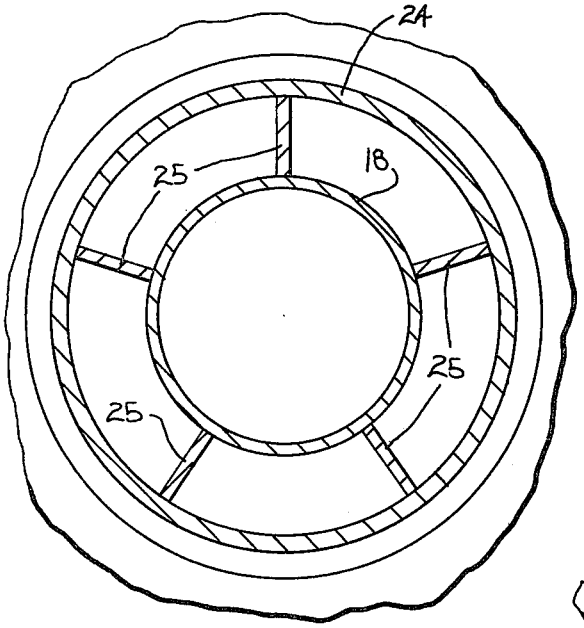
FIG.8
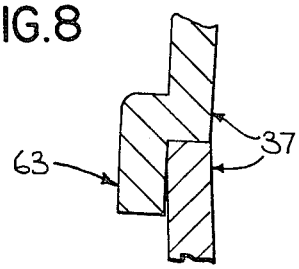
FIG.9
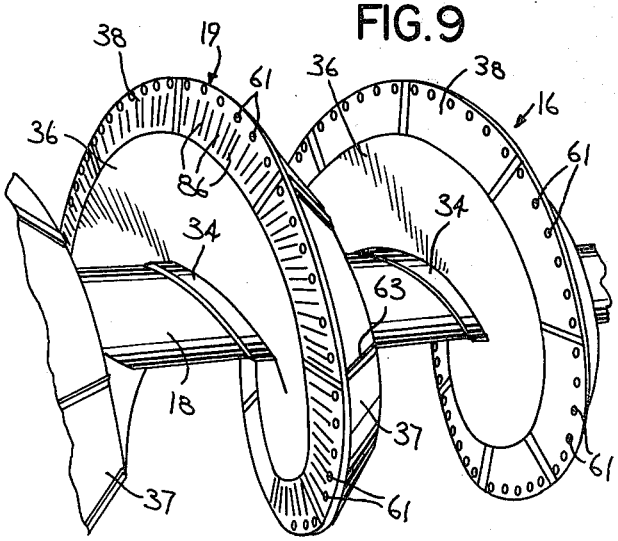

MATERIAL TREATING APPARATUS UTILIZING AN AUGER HAVING AN INTERNAL AIR SUPPLY AND HEAT TRANSFER SYSTEM

BACKGROUND OF THE INVENTION

In continuous feed systems, as utilized in industrial or municipal incinerators, waste material is continuously conveyed through the combustion chamber. Traditionally, the continuous feed incineration system has included a series of grates, which support the waste, and air is passed upwardly through the grates into contact with the waste material, while the ash and non-combustible materials pass downwardly through the grates and are collected in a water-filled trough. Waste is normally a low energy heat source, and as a result, certain materials, such as glass, plastic, and lower melting point metal alloys, will melt and form a slag which is apt to clog the grates and prevent air from passing through the grates into the mass of waste material. To counteract clogging, the conventional continuous feed system, as used in the past, has included a mechanism for agitating or moving the grates to dislodge the slag and to permit air to pass upwardly into the waste material.

Because of the problem in introducing adequate air through the grates into the waste material, the conventional continuous feed unit requires a relatively large volume conbustion chamber in order to adequately burn the combustible waste gases. Expensive and sophisticated controls are normally, required with the conventional continuous feed system in order to monitor various conditions in the system. Controls are required to monitor the air pressure in the combustion chamber to determine whether the grates are partially clogged, and to monitor the temperature in the combustion chamber and thereby control the air input through the grates to obtain proper burning. Because of the complexity of the controls, the cost of the conventional continuous feed incinerator is substantial.

More recently, a continuous feed incineration system, incorporating an auger combustor, such as that disclosed in U.S. Pat. No. 4,231,304, has been utilized. In this type of incinerator, a rotatable auger is mounted within a cylindrical combustion chamber and is conveyed through the combustion chamber and agitated by the auger. The ash and non-combustible materials are discharged from the opposite or downstream end of the combustion chamber, while the gases generated from the combustion process are passed through a heat exchanger and then discharged through a separator to the atmosphere.

As disclosed in the aforementioned patent application, the auger includes a tubular shaft and a hollow spiral flight which is carried by the shaft. Air is introduced into the downstream end of the hollow shaft and passes into an air passage which extends continuously through the spiral flight. The air is discharged from the flight into the combustion chamber through a plurality of ports formed along the length of the flight.

The auger acts to slowly convey and agitate the waste material, and air is discharged, not only within the mass of the combustible waste material, but is also discharged into the upper portion of the combustion chamber where it serves to burn the waste gases of combustion in a secondary combustion zone.

As disclosed in the aforementioned U.S. patent, the hollow auger flight is also provided with a cooling water passage which extends the length of the flight.

Water is introduced into the water passage and serves to cool the auger. The water is heated as it passes through the water passage, and the heated water is discharged from the auger shaft and can be used for auxiliary heating purposes.

SUMMARY OF THE INVENTION

The present invention is directed to a material treating apparatus, such as an incinerator, incorporating an auger having an internal air supply system and an internal heat transfer mechanism. The apparatus is an improvement over that set forth in the U.S. Pat. No. 4,231,304.

In accordance with the invention, the auger is composed of a forward wall, facing downstream, and a rear wall which is spaced from the forward wall to define a central air passage. Both the forward and rear walls are composed of generally parallel wall panels which define a plurality of radially spaced passages which extend the length of the flight. Ports connect the radially spaced passages, and a heat transfer medium is introduced into the downstream ends of the passages and flows countercurrently to the flow of material. When employed as an incinerator, the heat transfer medium can take the form of cooling water which acts to cool the auger. The heated water is discharged from the upstream end of the auger and can be used for auxiliary heating purposes.

The outer extremities of the forward and rear wall are connected together by a pair of castings which define the apex of the spiral flight. Outlet ports are located along the periphery of the castings and air from the central auger chamber is discharged through the ports into the combustion or treating chamber.

The castings, which comprise the outer section or apex of the spiral flight, are each formed in relatively short sections and are bolted to the respective forward and rear walls of the flight. Similarly, the outer edges of the castings are bolted together. The bolted construction simplifies the assembly of the hollow spiral flight.

To prevent warping of the auger shaft during assembly of the spiral flight, curved saddle plates are initially tack welded to the outer surface of the shaft and the forward and rear wall panels are then welded to the saddles. As the wall panels of the flight are not welded directly to the shaft, warpage of the shaft isprevented, thereby insuring that the auger will maintain proper alignment within the combustion chamber.

The forward, or downstream, face of the spiral flight is provided with a series of radially extending ribs which act to agitate the waste material, as well as preventing clogging of the air ports.

In an incinerator, the auger construction of the invention provides improved air distrubtion into the mass of combustible material and into the upper portion of the combustion chamber, thereby resulting in a substantially complete combustion of all the solid waste material, as well as the combustible waste gases. The auger construction also includes an improved water cooling system in which a plurality of water passages are provided in both the forward and rear walls of the flight, with the volume of water being controlled so that the largest volume of water is circulated through the outermost passage which encounters the highest temperatures.

The invention can also be used in non-combustion processes for drying or concentrating moisture-laden materials, such as sewage sludge, grain, food products, and the like, or chemical reaction processes.

Other objects and advantages will appear in the course of the following description.

DESCRIPTION OF THE DRAWINGS

The drawings illustrate the best mode presently contemplated of carrying out the invention.

In the drawings:

FIG. 5 is a fragmentary transverse section showing the introduction of water into passages of the flight;

FIG. 6 is an enlarged fragmentary longitudinal section showing the hollow flight construction;

FIG. 7 is a section taken along line 7—7 of FIG. 4;

FIG. 8 is a view showing the overlapped joint between the outer casing sections of the spiral flight; and FIG. 9 is a perspective view of a portion of the auger.

DESCRIPTION OF THE PREFERRED EMBODIMENT

Figure 1:
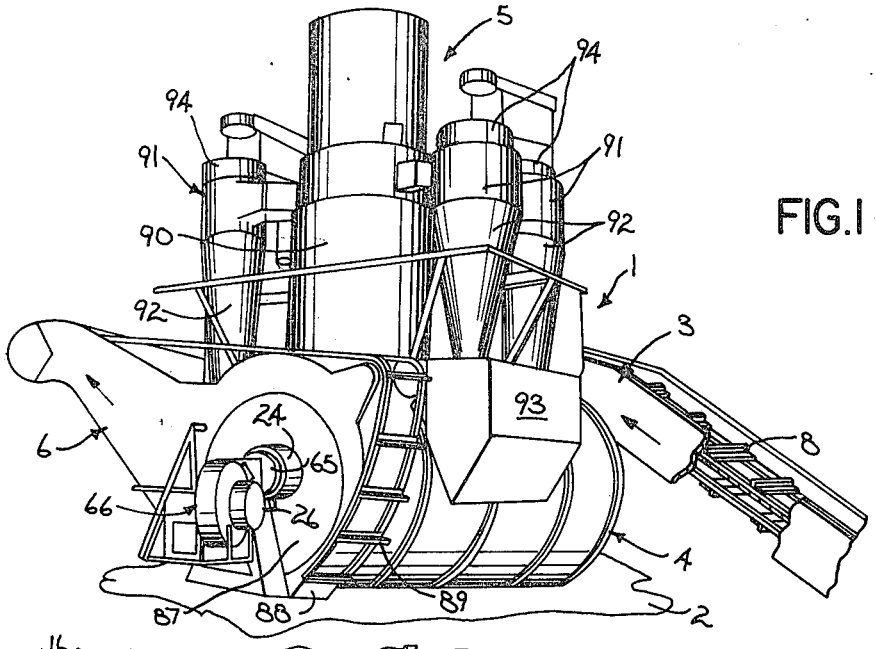
FIG. 1 is a perspective view of the incinerator of the invention.

The drawings illustrate an incinerator 1 which is mounted on a foundation 2 and, in general, includes a waste feed unit 3, and auger combustor 4, a waste gas treatment unit 5, and an ash and non-combustible removable unit 6.

The waste material is introduced into the waste feed unit 3, which conveys the waste to the inlet end of the combustor 4 where the combustible materials are burned and the ash and non-combustible residue is discharged through the ash removal unit 6. The gases resulting from the combustion process pass through the gas treatment unit 5 and are ultimately discharged to the atmosphere.

The feed unit 3 includes a hopper 7 which is mounted on the upper surface of the auger-combustor 4, and a standard cleat-type conveyor 8 is associated with the hopper. Waste material fed to the lower end of the hopper 7 is conveyed upwardly by conveyor 8 and is discharged into the combustor unit 4.

The auger combustor unit 4 includes an outer cylindrical housing 9 which is enclosed by heads 10 and 11. The housing 9 is composed of an outer metal shell 12 which is provided with a standard refractory lining 13.

One end of the housing 9 is provided with a feed opening 14 which communicates with the hopper 7 so that waste material deposited in the hopper will be fed through opening 14 into the interior of the housing 9.

The auger-combustor unit 4 also includes an auger 15 which is mounted for rotation within the housing 9 and serves to convey the waste material through the combustion chamber 16. The ash and non-combustible residue is discharged through an outlet 17 in the downstream end of the housing and delivered to the ash removal unit 6.

The auger 16 is composed of a tubular shaft 18 which extends the length of the housing 9 and a hollow spiral flight 19 which is secured to the shaft 18.

To journal the auger 15 for rotation, a pair of rollers 20 are mounted on roller brackets 21 located adjacent the upstream end of the housing 9. During rotation of the auger, the upstream end of shaft 18 rides on the rollers 20. In addition to rollers 20, a pair of rollers 22 are mounted on opposite sides of the upstream end of auger shaft 18 and ride on collar 23 which is secured to head 10 of the combustor unit 4.

Figure 4:
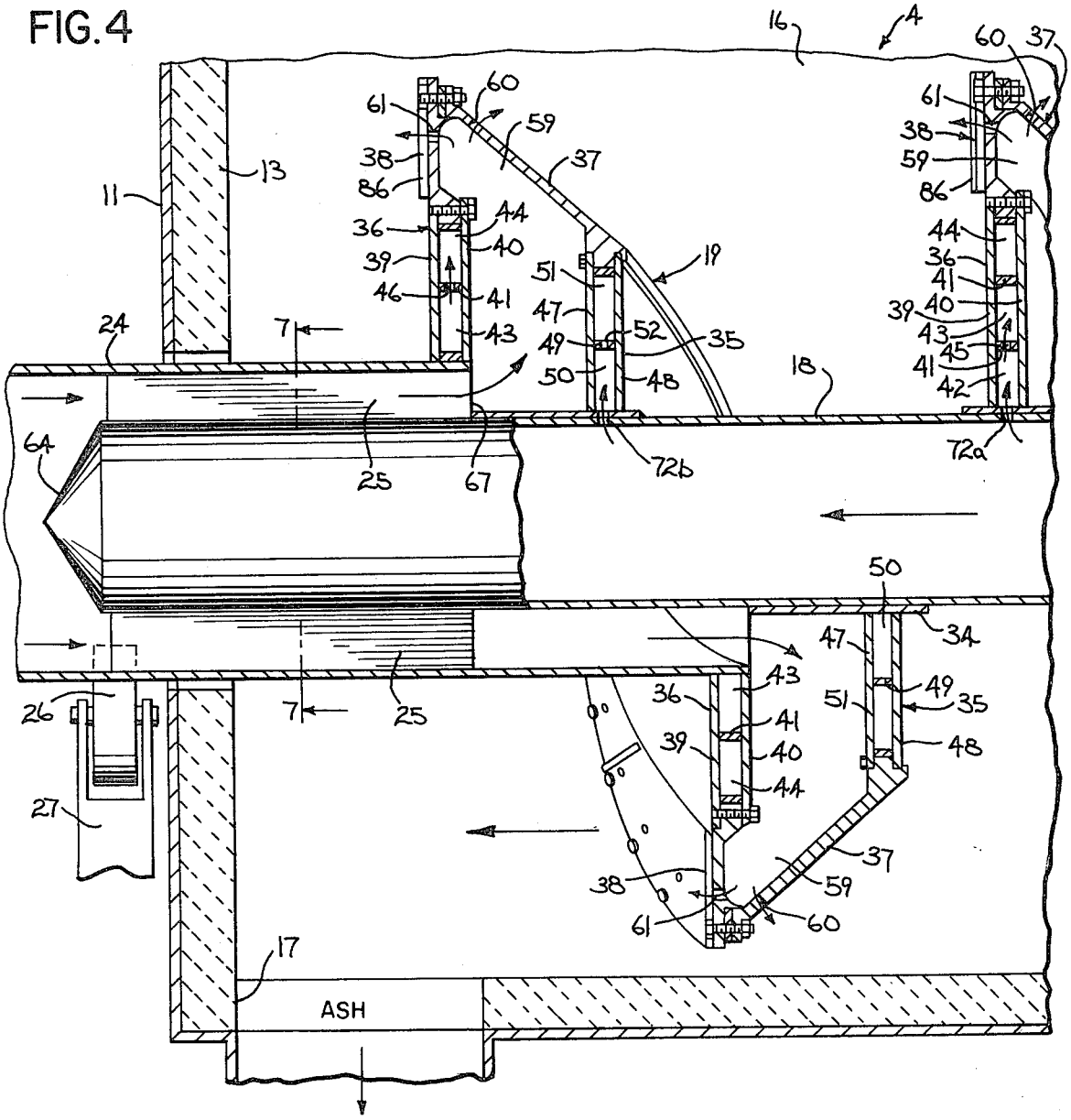
FIG. 4 is a fragmentary enlarged longitudinal section of the downstream or outlet end of the incinerator.

To mount the downstream end of the auger shaft 18 for rotation, a cylindrical manifold 24 is secured to the downstream end of the auger shaft 18 through a series of radially extending fins 25. The function of the manifold will be described hereinafter. Rollers 26, which are mounted for rotation on brackets 27 attached to the frame of the incinerator, support the projecting end of the manifold 24, as best shown in FIG. 4, thereby acting to journal the downstream end of the auger for rotation.

To drive the auger 15, a drive sprocket 38 is mounted on shaft extension 29 which projects from the upstream end of shaft 18, and the sprocket is connected by a chain 30 to the output shaft of a hydraulic variable speed drive unit 31. With this drive system, the speed of rotation of the auger can be varied as desired.

To initially begin combustion of the waste material in the combustion chamber 16, a conventional gas burner 32 and igniter 33 are mounted in the housing 9 adjacent the upstream end of the combustion chamber. After a period of about 15 minutes, when the combustion of the waste material has been fully established, the heat generated by the burning of the combustible material will be sufficient to carry on the process so that operation of the burner 32 can be discontinued.

The auger 15 includes a series of curved saddle plates 34 which are located between the spiral flight 19 and the shaft 18. In fabricating the auger, the curved saddle plates are initially tack welded to the shaft 18 and arranged in a generally helical pattern on the outer surface of the shaft. The inner edges of the flight 19 are then welded edgewise to the saddle plates, and after the flight has been completely assembled, the projecting edges of the saddle plates are partially trimmed away. It is important that the auger shaft be in a straight axial condition without warpage in order that the auger will be maintained in proper alignment within the combustion chamber. By utilizing the saddle plates 34, which are only tack welded to the shaft, the flight is not welded directly to the shaft, thereby elimianting warpage or stresses in the shaft. After welding, the spiral flight 19, by virtue of shrinkage, will be clamped tightly around the shaft 18.

The spiral flight 19, as best illustrated in FIG. 4 is composed of an inner upstream wall section 35, an inner downstream wall section 36, an upstream outer cast wall section 37 and a downstream cast wall section 38. The cast wall sections 37 and 38 are connected together along the apex of the flight 19.

The downstream inner wall section 36 is composed of a pair of wall panels 39 and 40 which are spaced apart by spacers 41 to define three passages 42, 43 and 44, which extend the length of the flight. The passages 42–44 serve as separate conduits for the flow of a cooling medium, such as water, which is introduced into the innermost passage 42 at the downstream end of the auger, as will be more fully described hereinafter.

Port 45, which is located adjacent the downstream end of the auger, provides communication between the innermost passage 42 and central passage 43, while port 46 connects the central passage and the outer passage 44, as shown in FIG. 4.

The upstream inner wall section 35 is composed of a pair of generally parallel wall panels 47 and 48 which are spaced apart by spacers 49 to define two water passages 50 and 51, which extend substantially the full length of the spiral flight. Holes 52, which are located adjacent the downstream end of the flight provide communication between the passages 50 and 51,, and as in the case of the downstream wall section 36, the size and distribution of the holes 52 are such that the greatest volume of water is delivered through the outer passage 51 which encounters the highest temperature in service.

As illustrated in FIG. 4, the inner edges of wall panels 39 and 40 and 47 and 48 are welded to the saddle plates 34 and the side edges of the saddle plates project slightly beyond the respective wall panels.

the upstream outer section 37 is formed of cast iron and is provided with a flange 53 along its inner edge which is positioned between the wall panels 47 and 48 and connected to the wall panels by bolts 54. Similarly, the cast section 38 is provided with an inner flange 55 which is connected between the outer extremities of wall panels 39 and 40 by bolts 56. The outer extremities of the cast sections 37 and 38 are spaced apart by a strap 57 and bolts 58 extend through the outer extremities of the sections 37 and 38, as well as through aligned holes in strap 57 to connect the outer sections together. As will be described hereinafter, air is supplied to the central chamber 59 of the flight and the air is discharged into the combustion chamber through a series of ports 60 located in the outer portion of upstream section 37 and through a series of ports 61 which are located in the outer portion of downstream section 38. In addition, the outer extremities of the sections 37 and 38 are formed with grooves 62 which border the strap 57 and air is also dishcarged through the grooves 62 into the combustion chamber, as best shown in FIG. 6.

As previously noted, the outer sections 37 and 38 are castings and the side edges of adjacent cast sections 37 and 38 are provided with overlapping joints 63, as illustrated in FIG. 8. The overlapping joints 63 are not welded or otherwise connected, and the bolted attachment of the outer sections 37 and 38 to the inner sections 35 and 36 will provide a tight overlapping joint without the necessity of welding.

The downstream end of the shaft 18 is spaced inwardly from the manifold 24 by the radially extending fins 25, and the downstream end of the shaft is provided with a conical tip 64, as shown in FIG. 4. One end of an air supply duct 65 is connected to the downstream end of the manifold 24, which projects outwardly of the housing 9, while the opposite end of the duct 65 is connected to a blower unit 66.

As best illustrated in FIGS. 4 and 5, the inner periphery of the downstream end of the flight 19 is provided with a gap 67 which extends 360° and the upstream end of the manifold 24 is mounted within the gap. With this construction, air under pressure from blower 66 will be discharged through duct 65 into the manifold 24 and will then pass through the gap 67 into the central chamber 59 in the spiral flight 19. As previously noted, the chamber 59 extends substantially the whole length of the flight and air will be discharged from the chamber 59 through the ports 60, 61 and grooves 62 into the interior of the combustion chamber 16. A portion of the air will be discharged into the mass of the combustible material to agitate and aid in burning the waste material, while a second portion of the air will be discharged into the upper portion of the combustion chamber above the level of the solid waste. The air discharged into the upper portion of the combustion chamber will aid in fully combusting the waste gases of combustion in a second combustion zone.

As a feature of the invention, water is supplied to the auger 15 to cool the auger and to generate hot water or steam for auxiliary heating purposes. In this regard, a water line 68 is connected through a standard swivel joint 69 to pipe 70 which extends axially of the auger shaft 18. The inner end of pipe 70 is mounted within an opening in a transverse baffle 71 that is located downstream of head 10. With this construction, cooling water supplied through line 68 can flow through the pipe 70 into the interior of the auger shaft 18. The cooling water is delivered from the interior of the shaft 18 into the innermost water passages 42 and 51 through holes **72*a* and 72*b*, respectively. A portion of the water entering the passage 50 will flow through holes 52 into the outer passage 51 so that the water will then be conducted through both passages 50 and 51** toward the upstream end of the auger.

As the innermost passage 42 of the downstream wall section 36 is interrupted for 360° by the air gap, the hole **72*a* is located a full turn or convolution from the downstream end of the wall section 36 and a provision is made to circulate the water into the portions of the outer passages 43 and 44 located downstream of hole 72*a* and outwardly of gap 67. As best shown in FIGS. 4 and 5, divider wall 73 interconnect the manifold 24 and shaft 18 at the ends of the gap 67 to separate and air passage from the water passages. To distribute the water flow entering the inner passage 42 through hole 72*a*, a wall 74 is secured across the passage 42, upstream of hole 72*a* and is provided with a flow distributing orifice 75. Similarly, a wall 76 is mounted across the central passage 43, upstream of hole 45, and is provided with a flow distributing orifice 77. With this construction, a portion of the water entering the chamber 42 through opening 72*a* will flow through the orifice 75 and then flow toward the upstream end of the auger, while a second portion of the water will flow through hole 45 into central passage 43 and then through orifice 77 toward the upstream end of the auger. The third and major portion of the water will flow downstream through the central chamber 43, and at the downstream end of the flight will pass through the opening 46 into the outer chamber 44 and will then flow upstream to the upstream end of the auger. The size and distribution of the holes 45 and 46 and orifices 75 and 77 is such that about 60% of the volume of water flows through the outer passages 44, 30% through the central passage 43, and about 10% through the inner passage 42**. With this construction, the largest volume of water is delivered to the portion of the flight wall which encounters the highest temperature.

Using this construction, the water flow is reversed so that the cooling water will flow to the downstream end of the flight, even though the innermost passage 42 is interrupted by the air entry gap 67.

Figure 2:
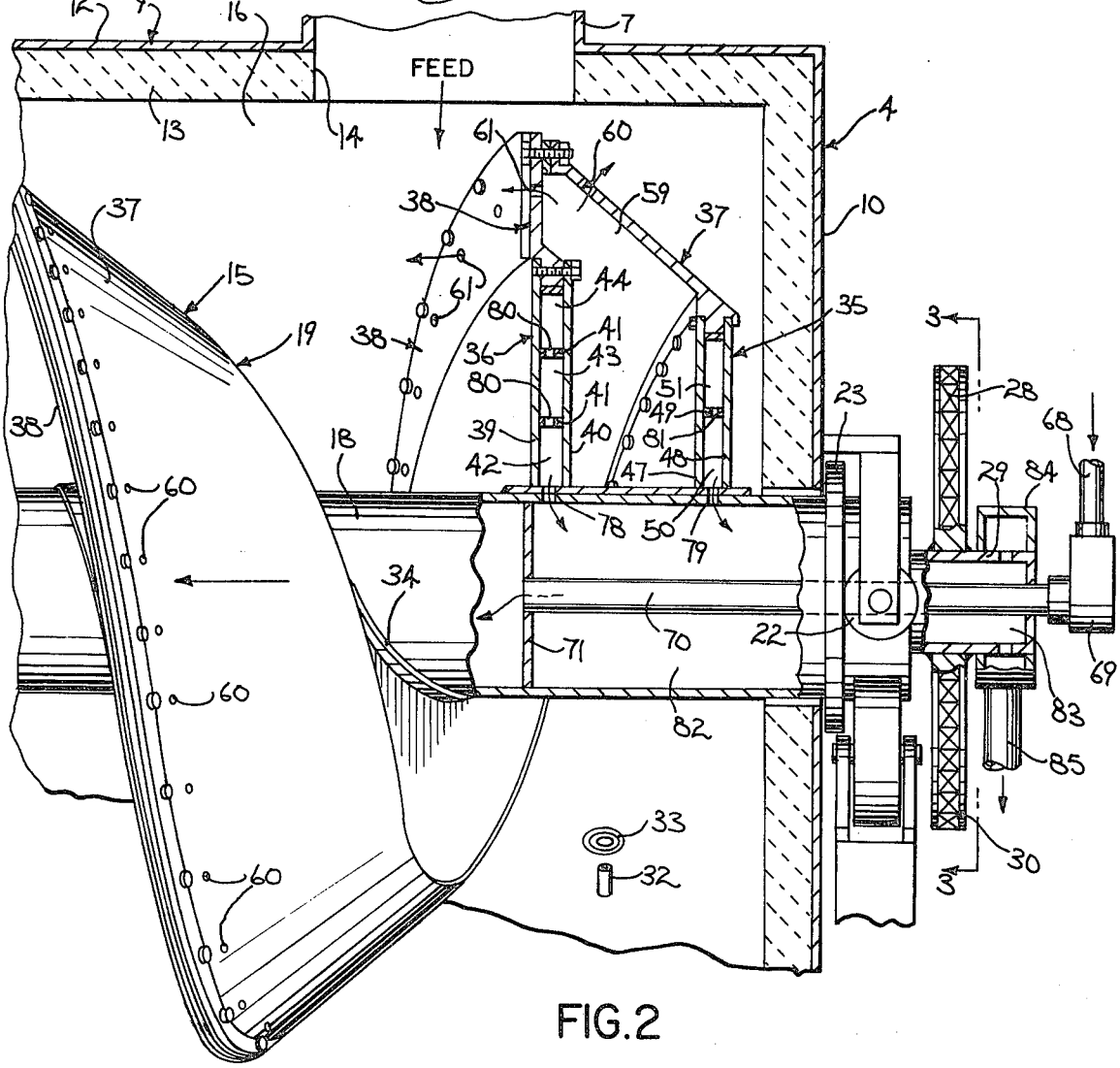
FIG. 2 is a fragmentary longitudinal section of the inlet or upstream end of the incinerator.
Figure 3:
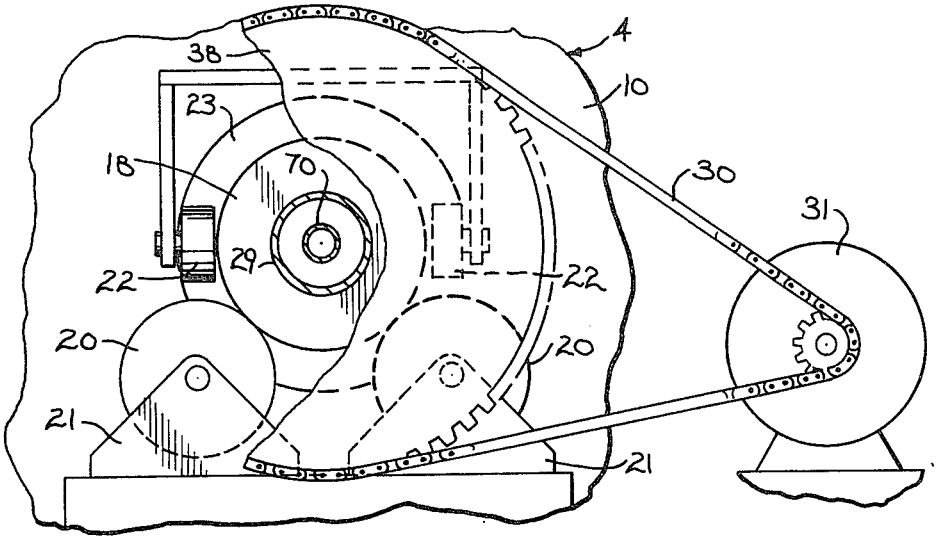
FIG. 3 is a section taken along the line 3—3 of FIG. 2.

Heated water or steam is discharged from the upstream end of the auger 15. As shown in FIG. 2, holes 78 and 79 communicate with the upstream end of passages 42 and 50, resepectively, while ports 80 connect passages 42, 43 and 44 and ports 81 connected passages 50 and 51. Thus, the heated water from the passages in both the upstream and downstream wall sections 35 and 36 is discharged into the annular chamber 82 surrounding pipe 70. The outer end of chamber 82 communicates with the annular chamber 83 located within the shaft extension 29, the chamber 83 is connected through a conventional collector ring 84 to the water discharge line 85.

The downstream cast sections 38, with the exception of the cast sections 38 located adjacent the feed inlet 14, are provided with radial ribs 86, as best illustrated in FIG. 9. The ribs 86 aid in agitating the waste material and also prevent clogging of the air holes 61.

The ash and other non-combustible materials are discharged from the downstream end of the combustion chamber 16 through outlet 17 to the ash removal unit 6. Ash removal unit 6 includes a housing 87 and the lower portion of the housing defines a water-filled collection trough 88 which receives the ash and non-combustible materials. A standard cleat-type conveyor 89 is mounted for travel in the trough 88 and serves to convey the residual material upwardly to a suitable collection area.

The gaseous products of combustion are discharged from the combustion chamber 16 into a stack 90 which incorporates a heat exchanger of conventional type, which can be used to heat a fluid, such as water for auxiliary heating purposes.

The gases being discharged from the heat exchanger then flow through a group of conventional cyclone separators 91. The cyclone separators are of conventional type and serve to separate particulate materials, such as fly ash, from the gases. Each cyclone separator includes a downwardly tapering housing 92 which terminates in a collection bin 93, and a blower 94 is mounted on top of the housing. The fly ash particles, being more dense than the gas, will fall downwardly within the housing into the collection bin, while the gases are discharged through the blower to the atmosphere.

The novel auger construction of the invention utilizes an air supply system which continuously supplies air through the spiral flight beneath the level of the waste material, and the rotating auger provides constant agitation of the waste to present new surfaces for burning. The discharge of air from the flight into the upper portion of the combustion chamber, above the level of waste, provides a secondary combustion zone for the combustible waste gases to prevent smoke from being discharged from the incinerator, thereby eliminating the need for an afterburner.

The improved efficiency brought about by the auger construction of the invention enables the incinerator to effectively burn wet or moist material, such as garbage, manure, leaves, and the like, as well as finely divided powdery material, such as sawdust, plastic, peanut shells, and the like.

The novel water supply system not only cools the auger but provides a supply of hot water or steam for auxiliary heating purposes.

While the above description has illustrated the invention as applied to an incineration process, it is contemplated that the invention can be used in non-combustion applications, for drying of moist materials, such as sewage sludge, grain, food products, chemicals, and the like, or for chemical reaction processes. In an operation of this type, air is introduced through the central air chamber 59 in the auger into contact with the material being treated in the chamber 16 and a heated fluid, such as hot water or steam, can be introduced into the heat transfer passages 42–44, 50 and 51, to heat the material being treated.

Various modes of carrying out the invention are contemplated as being within the scope of the following claims particularly pointing out and distinctly claiming the subject material which is regarded as the invention.

I claim:

1. An auger construction for use in an apparatus for treating a material, said auger being mounted for rotation in an elongated treating chamber, said auger comprising a tubular shaft, and a hollow spiral flight secured to the outer surface of the shaft, a tubular manifold spaced outwardly of the shaft and located at the downstream end of the auger, the downstream end of said flight being connected to the manifold and spaced radially from the shaft to provide a passage that provides communication between the manifold and the interior of the flight, air supply means for supplying air to the manifold with said air passing through said passage and into the interior of said flight, and port means in said flight for discharging the air into the interior of the treating chamber.

2. The construction of claim 1, wherein approximately one convolution of said flight is spaced from said shaft and said passage extends through an arc of approximately 360°.

3. The construction of claim 2, wherein said flight includes a downstream section and an upstream section, the outer extremities of said sections meeting at an apex, said port means comprising a plurality of first ports disposed in said downstream section and a plurality of second ports disposed in said upstream section and a plurality of third ports disposed at said apex.

4. An auger construction for use in moving material from the feed end of a treating chamber in a downstream direction to a discharge end, said auger comprising a tubular shaft and a hollow spiral flight carried by the shaft, said flight including a wall section composed a pair of spaced wall panels that define a plurality of radially spaced heat transfer passages, means to supply a heat transfer medium to the innermost passage at one end of said auger, means at the opposite end of the auger to discharge said medium from said innermost passage, and flow control means to distribute the flow of said medium between said passages, whereby the greatest volume of said medium will pass through the outermost of said passages.

5. The contruction of claim 4, wherein said flow control means comprises orifice means to control the flow within said passages.

6. The construction of claim 4, and including a pair of wall sections which are spaced apart to provide a central air passage therebetween, each of said wall sections being composed of spaced wall panels which define radially spaced heat transfer passages, said construction having means to supply a heat transfer medium to one end of said innermost passage.

7. The construction of claim 6, wherein said flight includes an outer cast iron section secured to the outer extremity of each wall section, the outer extremities of said outer sections being joined together at an apex, the space between the wall sections defining a central air chamber, means to supply air to said air chamber, and port means disposed in said outer sections for discharging air from said air chamber into the treating chamber.

8. An auger construction for moving an agitating material from a feed end of a chamber to a discharge end, said auger including a hollow shaft, a curved saddle tack welded to the outer surface of the shaft and arranged in a generally spiral configuration, and a hollow spiral flight secured to the outer surface of the saddle, said flight including an upstream wall section and a downstream wall section which are spaced apart to provide a central chamber, the inner edges of said wall sections being welded edgewise to the outer surface of said saddle.

9. The construction of claim 8, wherein the side edges of the saddle extend laterally beyond the respective side edges of the wall sections.

10. An auger construction for use in agitating material and moving the material from a feed end to a discharge end of a treating chamber, said auger construction comprising a tubular shaft and a hollow spiral flight carried by the shaft, said flight composed of an upstream wall section and a downstream wall section joined together at their outer extremities at an apex and defining a central chamber therebetween, air supply means for supplying air to the central chamber, a plurality of ports in said wall sections for discharging air from the central chamber into the combustion chamber, and a plurality of external ribs on the downstream wall section and disposed between the ports in said downstream section, said ribs acting to agitate the material and to prevent clogging of said ports.

11. The construction of claim 10, in which said ribs are located at the outer extremity of said downstream wall section and extend generally radially with respect to the axis of said shaft.

12. An incinerator, comprising a housing defining a combustion chamber, an auger mounted for rotation within the housing, feeding means for feeding waste to a first end of said combustion chamber, discharge means for discharging ash and non-combustible residue from the opposite end of the combustion chamber, said auger serving to convey the waste material in a downstream direction from the first end to the opposite end of the combustion chamber, said auger comprising a tubular shaft and a hollow spiral flight carried by the shaft and extending substantially the entire length of said combustion chamber, a tubular manifold spaced outwardly of the downstream end of the shaft, the downstream end of said flight being connected to the manifold and spaced radially outward from the shaft to provide a passage that provides communication between the manifold and an interior chamber in said flight, air supply means supplying air to the manifold, said air passing through said passage and into said interior chamber, said flight includes an upstream wall section and a downstream wall section that are spaced apart to define said interior chamber, said upstream wall section having a plurality of air discharge ports for discharging air from said interior chamber into said combustion chamber, each wall section including a pair of spaced wall panels defining a plurality of radially spaced cooling passages, means to supply cooling water to the downstream end of said passages, said water flowing in an upstream direction through said passages, means for discharging heated water from the upstream ends of said passages, and a plurality of external ribs mounted on the outer surface of the downstream wall section adjacent the apex of the flight and located between said ports, said ribs acting to agitate the waste material and prevent clogging of said ports.

13. The construction of claim 3, and including a strap located between th outer extremities of said sections at said apex, at least one of said sections being provided with a plurality of radially extending grooves bordering said strap, said grooves defining a group of air discharge ports for discharging air from said interior chamber into the combustion chamber.

* * * * *

UNITED STATES PATENT AND TRADEMARK OFFICE

CERTIFICATE OF CORRECTION

PATENT NO. : 4,342,269

DATED : August 3, 1982

INVENTOR(S) : GORDON H. HOSKINSON

It is certified that error appears in the above-identified patent and that said Letters Patent are hereby corrected as shown below:

Col. 2, line 46, insert space between "is" and "prevented";
Col. 3, line 31, cancel "and" and substitute therefor ---an---;
Col. 5, line 14, Cancel "the" and substitute therefor ---The---;
Col. 6, line 28, cancel "and" and substitute therefor ---the---;
Col. 8, line 34, After "composed" insert ---of---; Col. 10, line 19, cancel "end" and substitute therefor ---ends---; Col.10, line 29, Cancel "th" and substitute therefor ---the---.

Signed and Sealed this

*Sixteenth* Day of *November 1982*

[SEAL]

*Attest:*

GERALD J. MOSSINGHOFF

*Attesting Officer*

*Commissioner of Patents and Trademarks*